US005984690A

United States Patent [19]

Riechelmann et al.

[11] Patent Number: 5,984,690

[45] **Date of Patent: *Nov. 16, 1999**

[54] CONTACTOR WITH MULTIPLE REDUNDANT CONNECTING PATHS

[76] Inventors: Bernd Riechelmann; Raymond Twigg, both of 9920 Scripps Lake Dr., #108, San Diego, Calif. 92131

[ * ] Notice: This patent is subject to a terminal disclaimer.

[21] Appl. No.: 08/745,705

[22] Filed: Nov. 12, 1996

[51] Int. Cl.[6] ..... H01R 9/09

[52] U.S. Cl. ..... 439/66

[58] Field of Search ..... 439/66, 70, 73, 439/74, 91, 591

[56] References Cited

U.S. PATENT DOCUMENTS

| | | | |
|---|---|---|---|
| 4,344,662 | 8/1982 | Dalamangas et al. | 439/91 |
| 4,402,562 | 9/1983 | Sado | 439/91 |
| 4,453,309 | 6/1984 | Shirk | 29/884 |
| 4,506,215 | 3/1985 | Coughlin | 324/158 P |
| 5,069,629 | 12/1991 | Johnson | 439/71 |
| 5,207,584 | 5/1993 | Johnson | 439/66 |
| 5,237,743 | 8/1993 | Busacco et al. | 29/885 |
| 5,385,477 | 1/1995 | Vaynkof et al. | 439/66 |
| 5,403,194 | 4/1995 | Yamazaki | 439/66 |

FOREIGN PATENT DOCUMENTS

| | | |
|---|---|---|
| 2726742 | 1/1978 | Germany . |
| 3009935 | 9/1980 | Germany . |

OTHER PUBLICATIONS

Specification Sheet From Zebra Connectors (Unnumbered and Undated).

*Primary Examiner*—Paula Bradley
*Assistant Examiner*—Tho Dac Ta
*Attorney, Agent, or Firm*—Thomas J. Tighe

[57] ABSTRACT

A contact array includes a plurality of uniform columns each for providing electrical continuity between things respectively in contact with opposite ends of the columns, each column means having a memory urging it to be straight. In a first embodiment the columns are all affixed to plurality of polymeric carrier films for holding them parallel to each other, spaced apart, aligned along an axis normal to them, and preferably symmetrical with respect to the axis. Each column can include a plurality of aligned, elongated contact leaves, each leaf having a memory urging it to be straight. In a second embodiment the columns each comprise a set, preferably ten, of loosely aligned contact leaves held in place by being disposed in slots defined by a housing. The housing forces the columns to be uniformly arcuate along the axis. The opposite ends of the columns define respective opposite contact margins of the array. A housing defines a chamber for containing the array and opposite openings through which the contact margins protrude for external contact therewith. The chamber further includes space to allow further, unobstructed, resilient arcuation of all the columns whenever the contact force is applied to the margins. The array can be moveable back and forth, over a range, in the directions that the forces are applied to the contact margins to equalize the forces.

18 Claims, 7 Drawing Sheets

CONTACTOR WITH MULTIPLE REDUNDANT CONNECTING PATHS

BACKGROUND OF THE INVENTION

This invention relates in general to solderless electrical contacts, and in particular to such contacts using resilient conductive columns made to buckle when contact pressure is applied, commonly called "buckling column" contacts.

Electrical contact reliability, particularly the prevention of continuity failure, becomes ever more important as contacts are both miniaturized and the number of leads per assembly increases. This invention addresses the problem of obtaining improved continuity by providing a plurality of parallel connecting paths for each separate lead of a connector assembly having a plurality of such leads. Therefore, the temporary or permanent failure of any one or more of the paths will not create a discontinuity and impair the performance of the entire connector as long as the number of failed paths per lead is less than the total number of connecting paths.

Additionally, this invention can reduce the contact resistance per lead in cases where the mating contact surface has high resistance due to contamination.

Additionally, this invention reduces contact inductance and contact capacitance to facilitate the efficient conduction of high frequency signals without distortion.

Additionally, this invention reduces distortion of high frequency signals by providing a controlled impedance transmission line for the signal path.

Other advantages and attributes of this invention will be readily discernable upon a reading of the text hereinafter.

SUMMARY OF THE INVENTION

An object of this invention is to provide a contact array having connection reliability by including a plurality of redundant connecting paths to ensure reliable connection even if some individual paths fail.

A further object of this invention is to provide a contact array having reduced contact resistance by including a plurality of parallel contact paths.

A further object of this invention is to provide a contact column having a plurality of parallel redundant contacts with ends having sharp corners which cut through surface contamination.

A further object of this invention is to provide a contact array having a buckling column contact consisting of a plurality of hardened, flat metal leaves fixed in position by means of being bonded to interleaved films of non-conducting polymer.

A further object of this invention is to provide a contact array having a buckling column contact consisting of a plurality of hardened, flat metal leaves disposed in separate grounded slots.

A further object of this invention is to provide a contact array having a buckling column contact consisting of a plurality of hardened round wires fixed in position by being bonded to films of a non-conducting polymer.

A further object of this invention is to provide a contact column having a plurality of parallel redundant contacts the ends of which fan out upon actuation, thereby providing contact "wipe" to improve continuity.

A further object of this invention is to provide a contact array including a plurality of contact columns held in place by means of being bonded to separate, dimensionally stable polymer films, stacked in layers which can move relative to each other, retained in a housing while permitting some movement to equalize contacting forces applied against opposite contact margins.

A further object of this invention is to provide a contact array including a multi-lead connector, each lead having a plurality of parallel redundant contacts which are compressible, and which connect two circuit panels, or connect an integrated circuit to a panel.

A further object is to provide a contact column including contact tips that are curved to concentrate contact force to a point.

A further object of this invention is to provide a contact array as described above with multiple redundant elements used for establishing solderless connections to an integrated circuit, for the purpose of bum-in, testing, or temporary or permanent installation.

A further object is to provide a contact array including a contact assembly in which the contacts due to their high redundancy, operate reliably even under very light pressure, so that unsupported integrated circuit leads can be contacted without deforming said leads.

A further object is to provide a contact array as described above in which the individual contact elements are fabricated from a hardened, high conductivity alloy such as beryllium copper, rhodium, beryllium nickel, Paliney-7, tungsten, or carbon steel and the like, or a combination of different alloys with complementary properties.

A further object is to provide a contact array as described above in which the contact elements are a layered composite of different materials, such as a high strength steel core clad with an outer layer of high conductivity copper, or plated with a precious metal such as gold or rhodium, to reduce contact resistance.

A further object of this invention is to provide a contact array as described above which employs a plurality of interleaved polymeric films instead of an elastomer as contact carriers, thereby eliminating three disadvantages of elastomers: 1) interference with the flexing of the contacts, 2) inadequate stiffness for positioning contacts, and 3) limited fatigue life.

A further object of this invention is to provide a contact array as described above in which sets of aligned contact leaves are loosely retained in separate slots defined by a housing.

A further object of this invention is to provide a contact array as described above in which the elements are made of an alloy which, although having high bulk resistance, may have other desirable properties, such as extreme hardness or corrosion resistance, and despite the high resistance of individual elements, a low overall resistance is still obtained due to the plurality of parallel paths.

A further object of this invention is to provide a contact array as described above in which the individual columns are not interleaved with non-conducting spaces, but where the entire length of the strip is filled with parallel conducting elements closely packed. Such an arrangement giving a universal, pitch independent connecting strip. In said design, longitudinal alignment of the contact strip relative to the contacts becomes unnecessary, thereby reducing manufacturing and maintenance costs.

A further object of this invention is to provide a contact array as described above in which the individual elements are insulated from each other by interleaved polymer films or by being coated with an insulating film, thereby improving high frequency current connection, comparable to litz wire.

A further object of this invention is to provide a contact array as described above in which such a connecting strip is used to connect to very tightly spaced electrical terminals, such as encountered on integrated circuit wafers or flat panel displays.

A further object of this invention is to provide compressible connecting contacts with reduced lead inductance and lead-to-lead capacitance, hereinafter referred to as "contact impedance." Advanced circuits, operating at higher frequencies, require reduced contact impedance. The reduction in impedance is achieved by reducing the length of the connecting contacts. A given contact, however, can not be arbitrarily shortened without loosing compressibility. The present invention provides a means of achieving compressibility in contacts of reduced length by dividing each contact into a plurality of thinner, more flexible elements.

A further object of this invention is to provide a controlled impedance transmission line for the signals traveling through the contacts by enclosing the contacts in grounded housing surfaces throughout their entire length.

A further object of this invention is to provide multiple redundant connecting paths even on very small contact areas such as encountered on integrated circuits, by twisting a plurality of fine wire strands into a rope, the ends of which provide a plurality of flexible contact points.

A further object of this invention is to provide space transformation, which changes the tight contact spacing, common to integrated circuit wafers or chips, to the wider spacing common to printed circuit boards, thereby making contact alignment less critical.

A further object of this invention is to provide Kelvin connections to closely spaced contact points by means of alternatively slanted rows of contact columns.

A further object of this invention is to provide more secure positioning of individual contact elements than is possible with an elastomer by bonding them singly to interleaved, dimensionally stable polymeric films, or by retaining them in individual slots defined by a housing.

These objects, and other objects expressed or implied in this document, are accomplished in one embodiment by an electrical contactor having a contact array that includes: (1) a plurality of uniform columns each for providing electrical continuity between things in contact with opposite ends of the columns, each column means having a memory urging it to be straight, and (2) non-conductive, flexible carrier means, to which the columns are affixed, for holding them parallel to each other, spaced apart, aligned along an axis normal to them, and symmetrical with respect to the axis. In a second embodiment the columns are confined in separate slots which hold them parallel to each other, spaced apart, aligned along an axis normal to them, and symmetrical with respect to the axis. In both embodiments a convex wall in a grounded housing forces all the columns to be uniformly arcuate along the axis, the opposite ends of all the columns defining respective opposite contact margins of the array. The housing defines a chamber for containing the array. The chamber is at least partially defined by a concave wall and the convex wall with openings at opposite ends of the walls through which the contact margins externally protrude. The contact margins are exposed to accept the compressive forces that are applied to them during operation. The walls and other surfaces of the housing that may come in contact with a lead are coated with a thin layer of insulation, such as hard anodizing with TEFLON impregnation. The chamber further includes space to allow further, unobstructed, resilient arcuation of all the columns whenever the compressive force is applied to the margins. In both embodiments each column preferably includes a set of aligned, elongated leaves of conductive material. In the first embodiment each leaf is bonded to a respective polymeric carrier film and the films are held aligned to align the leaves. A woven, non-conductive fabric can be used in place of the polymeric carrier film, as can a plurality of transverse, non-conducting threads, such fabric or threads can be made of a variety of materials, including KEVLAR. Additionally, the leaves can be an integral part of the fabric, rather than bonded thereto. In the second embodiment aligned sets of leaves are movably confined in separate slots defined by a plurality of partitions, i.e. divider walls, extending from the convex wall to the concave wall. In both embodiments the leaves each have a memory urging it to be straight. Preferably the housing allows the contact columns to freely move, within a range, back and forth in a direction parallel to the columns for equalizing the compressive contacting forces applied against them.

When not contacted by external objects, the contact leaf carriers (first embodiment) are retained by friction in the housing. The memory of the contact columns urges them to be straight, so that their midpoints push against the convex housing wall, and their tips push against the ridges of the opposite, concave housing wall, creating friction. Optionally, additional retention may be provided by means of the long ends of the carriers being trimmed to form tabs, which engage mating slots in the housing ends. The mating slots provide sufficient clearance however to permit the carriers to be moveable back and forth in a direction parallel to the column means, to permit equalizing of contacting forces. Additionally, the tabbed ends of the carriers may be attached movably to each other by loose rivets, pins, clasps, elastomeric adhesives, or some other means so that a stack of carriers may be handled and replaced as a single unit. In the second embodiment in which the contact leaves are un-supported by carrier films, the leaves are retained by their T-shaped ends which are wider than the retaining slots.

DESCRIPTION OF THE PREFERRED EMBODIMENT

Figure 2:
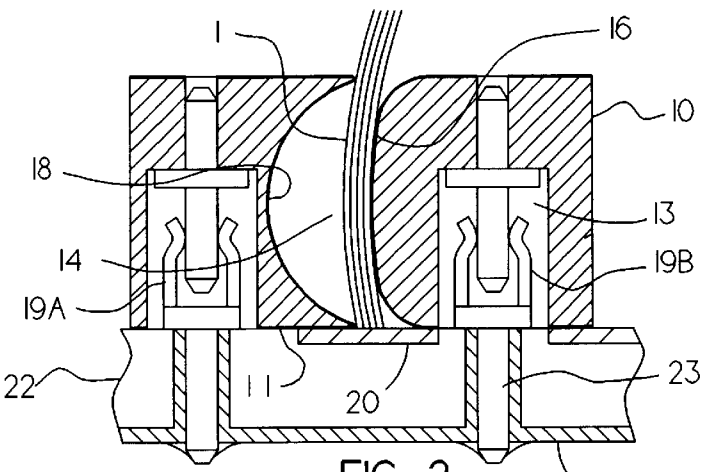
FIG. 2 is a diagrammatical cross-sectional view of the contact assembly of FIG. 1 abutting a printed circuit board.

Referring to FIGS. 1–6, a plurality of contact sheets 1 are illustrated to each include a carrier 4 in the form of a uniform, flexible sheet and a plurality of electrically conductive, elongated slat-like leaves 2 affixed to the sheet. The leaves are preferably of uniform width and individually bonded by an adhesive 3 to the carrier which is preferably a non-conductive polymeric film, e.g. polyimide (such as KAPTON made by Dupont). A woven, non-conductive fabric can be used in place of the polymeric carrier film, as can a plurality of transverse, non-conducting threads, such fabric or threads can be made of a variety of materials, including KEVLAR. Additionally, the leaves can be an integral part of the fabric, rather than bonded thereto. The leaves are resilient, each having a memory urging them to be flat and straight. As illustrated the contact sheets have a rectangular body with integral wing-like tabs, 6A and 6B, projecting laterally from opposite sides of the body, and the sheets are symmetrical about a median line (x—x). Each contact sheet 1 has a uniform set of leaves affixed to a face of its carrier such that the leaves are parallel to each other, preferably uniformly spaced apart, and normal to the median line. The leaves all extend to, and protrude from, opposite "terminal" margins of their carrier, 8A and 8B, the margins parallel to the median line. A contactor according to this embodiment uses a set of such contact sheets loosely bound in alignment such that the leaves of each sheet are aligned with corresponding leaves of all the other sheets of the set. Thus each set of contact sheets in a contactor has multiple sets of aligned leaves, and each set of aligned leaves functions as a single contact column for redundantly electrically connecting two points together.

Referring to FIGS. 1–4 and 5, the set of contact sheets is contained in a chamber 14 defined by a metal housing 10. The housing is preferably made of an aluminum alloy, for example aluminum alloys 7075-T6 or 6061-T6. Surfaces of the housing that touch the contact sheets and may touch other conductive traces or leads are coated with a thin layer of insulation 11, such as hard anodizing with TEFLON impregnation which is easily applied to aluminum surfaces. The housing also defines bores for accommodating grounding pins 12A and 12B, an upper portion of the pins being electrically connected to the metal of the housing by being press-fitted into un-insulated bores defined by the housing, and a lower portion of the pins being disposed in respective oversize bores 13. The housing also defines two opposite slot openings from the chamber through which respective terminal margins, 8A and 8B, of the contact sheets extend for exposing the tips of the leaves 2 to external electrical contact therewith. One wall 16 of the chamber is cylindrically convex and abuts against a "backside" of the set of contact sheets forcing the set to be partially buckled, i.e. arcuate, around the median line. A "frontside" wall 18 of the chamber opposite the convex wall defines a barrel-like recess, for allowing further unobstructed, resilient arcuation, i.e. buckling, of the leaves whenever compression forces act against the terminal margins of the sheets.

Figure 1:
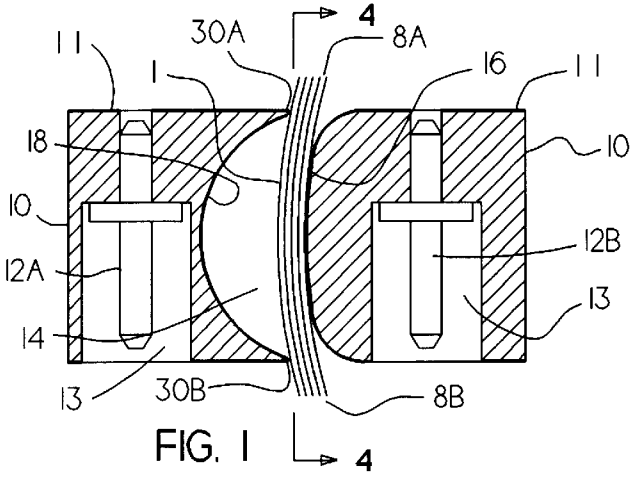
FIG. 1 is a diagrammatical cross-sectional view of a contact assembly according to this invention.
Figure 3:
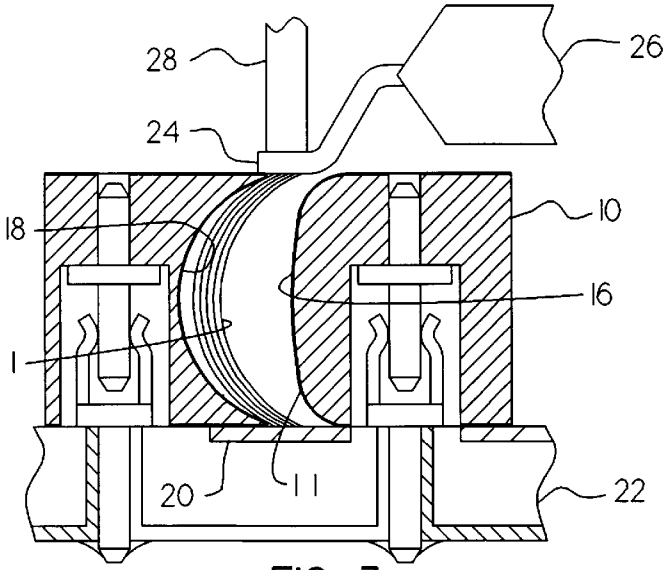
FIG. 3 is a diagrammatical cross-sectional view of the contact assembly of FIG. 1 in operation providing electrical continuity between a lead of an integrated circuit and a conductive strip on a printed circuit board.

This further unobstructed buckling of a set of contact sheets is best illustrated in FIG. 3 which shows the set of contact sheets of FIGS. 1 and 2 being compressed between a conductive trace 20 of a printed circuit board 22 and the leads 24 of an integrated circuit 26. A pushing device 28 applies contact force directly to leads 24 of the integrated circuit, thereby avoiding lead bending. The leads in turn apply compressive force to the leaves 2 of the contact sheets thereby further buckling the set. The applied force causes the sheets to buckle into the recess defined for that purpose by the frontside wall 18 of the chamber 14.

Referring to FIGS. 2 and 3, the grounding pins, 12A and 12B, are used to electrically couple the housing 10 to an electrical reference, such as a ground, for electrically shielding the contact sheets and providing a controlled impedance transmission line environment for signals traveling between, for example, a trace 20 and a lead 24. In these illustrations the electrical coupling is made by sockets, 19A and 19B, which fit into the oversize bores 13 and mate with respective grounding pins. The sockets are in turn electrically coupled to a ground plane 21 by pins 23 extending from the sockets. As illustrated the pins 23 extend through ground plated holes and are soldered to the ground plane.

As used herein, directional terms, such as "upper" and "lower" and "frontside" and "backside," are not meant to imply any necessary or absolute orientation of this invention, but rather are merely reference terms related only to the orientation of the invention as depicted in the drawings. This invention can in fact be used in any orientation.

In the preferred embodiment, due to the memory in the constituent leaves, the contact sheets each have a memory urging them to flex into a flat plane, but they are forced to be slightly cylindrically arcuate around the median line even in the absence of any compressive force. This initial curvature, which can be termed "pre-buckling", is to ensure that all the contact sheets buckle in the same direction when compressed as, for example, in FIG. 3. If they were straight and not slightly pre-buckled in the same direction, they would tend to buckle at random, in mutually opposing directions. They would thus interfere with each other's orderly buckling, leading to damage as by crushing. Depending on the method of manufacture chosen, the pre-buckling can be obtained in at least two ways.

In one way (FIGS. 1–4) the contact sheets are manufactured flat and are unstressed by their constituent leaves until they are inserted into a housing chamber 14. Once inserted, a set of such unstressed contact sheets is squeezed between the convex backside wall 16 of the chamber and rounded, projecting margins, 30A and 30B, of the concave frontside wall 18 such that the sheets are forced to be slightly bent. When an external compressive force is applied against the terminal margins of the contact sheet set, as in FIG. 3, the set buckles further away from the convex wall 16 and into the recess defined by the concave wall 18. In a second way, the leaves themselves are each manufactured to have a memory which urges them, and the films to which they are affixed to have a precise initial curvature.

Figure 4:
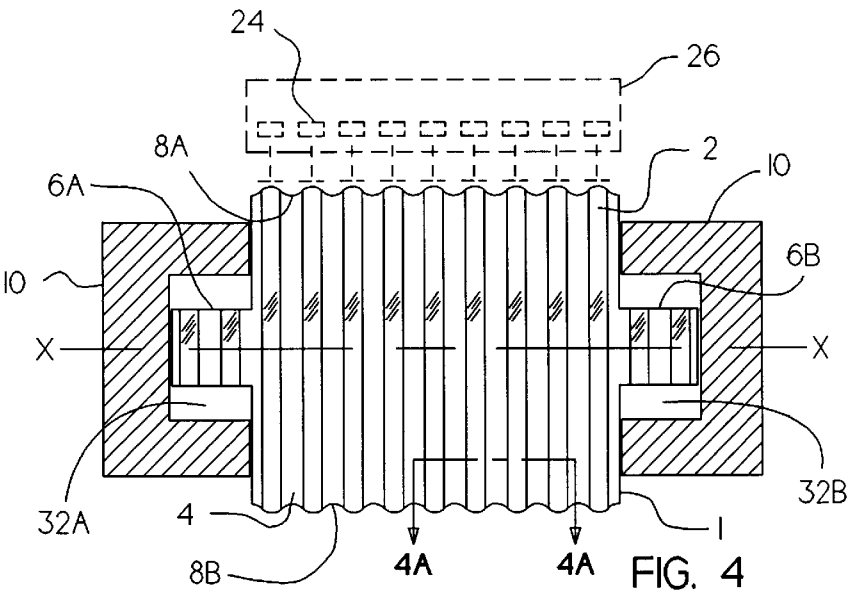
FIG. 4 is a diagrammatical cross-sectional view of the contact assembly of FIG. 1 taken along line 4—4.

Referring to FIGS. 1, 2 and 4, a set of contact sheets contained in the chamber 14 of a housing 10 is prevented from slipping out of the chamber, through one of the terminal margin openings, by the set's wing tabs, 6A and 6B, which are caught respectively in wing slots, 32A and 32B. The wing slots are smaller chambers extending from opposite sides of the main chamber 14, and are preferably oversized with respect to the wing tabs to give the contact sheets a range of movement to and from the terminal margin openings. This range of movement permits the contact sheets to move as necessary to establish electrical connections between the things being contacted.

Figure 6:
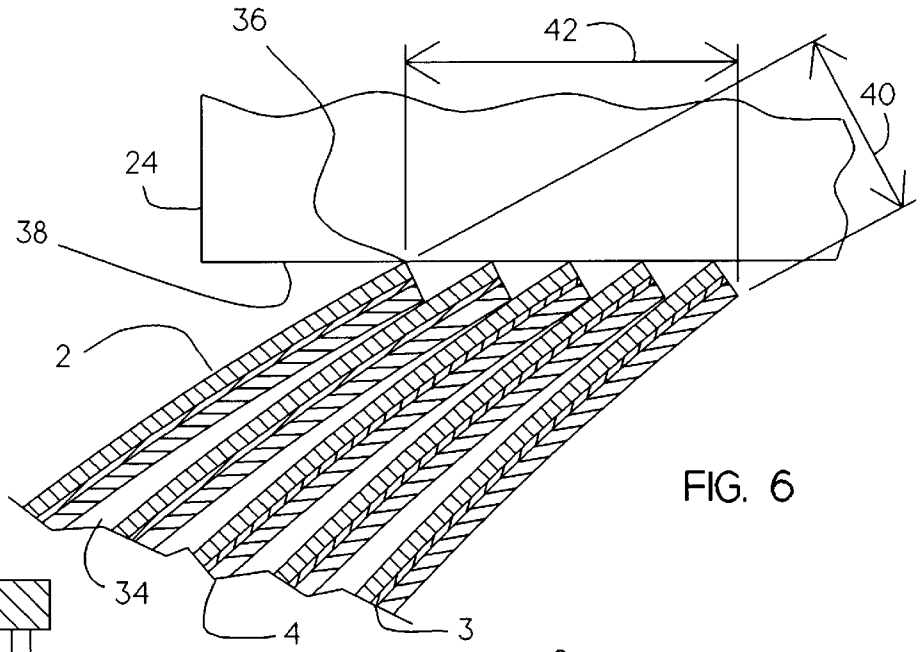
FIG. 6 is an enlarged partial cross-sectional view of a contact assembly abutting the lead of an integrated circuit, as in FIG. 3, illustrating some of the contact leaves impinging the lower surface of the lead.
Figure 4A:
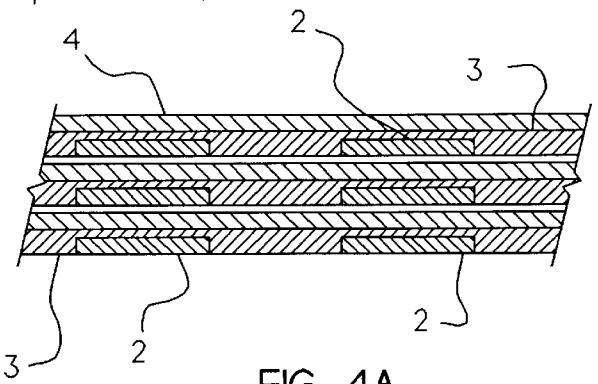
FIG. 4A is a diagrammatical cross-sectional view of the contact assembly of FIG. 4 taken along line 4A—4A.
Figure 5:
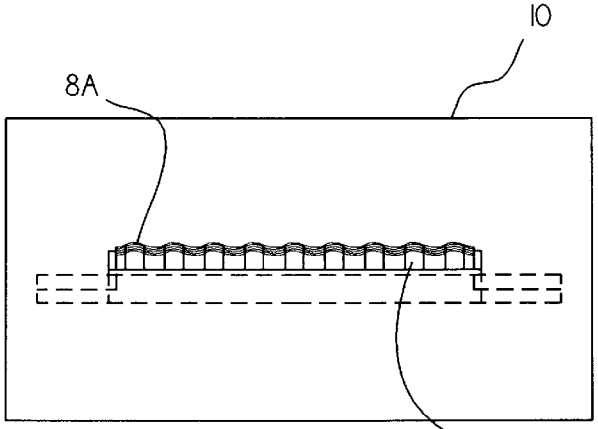
FIG. 5 is a plan view of the contact assembly of FIG. 1.

FIG. 6 illustrates how the loosely bound contact sheets 1 separately flex under compression, forming spaces 34 therebetween, and FIG. 4A best illustrates how each of the contact sheets consists of leaves 2 bonded to films 4 of polyimide. Polyimide is a polymer that is dimensionally stable under extremes of temperature. The sheets of polyimide therefore impart dimensional stability, thereby maintaining accurate pitch and contact alignment at temperature extremes. Although only five sheets are illustrated, it should be understood that many more, or fewer, sheets can be used without departing from the scope and objects of this invention. Preferably six to ten contact sheets are used per set. The ends of the contact leaves have sharp square corners 36 which can bite through any typical surface contamination 38 on an IC lead 24 or other conductor, and in response to contact force the sheets fan out to permit individual conformance to surface irregularities of the conductor. The fanning out causes what is commonly known as a "scrub effect" which scrubs away surface oxidation and contaminants, and is illustrated by arrows 40 and 42, arrow 40 showing the overall, un-fanned width of the five contact sheets, and arrow 42 showing the overall, fanned width of the five sheets.

Referring to FIGS. 4 and 4A, optionally the upper and lower tips of the contact leaves may each be curved to have a zenith in the direction of operational contact in order to concentrate contact forces to respective points. In phantom above the contact sheets is an integrated circuit ("IC") 26 with leads 24 having a certain "pitch" (which refers to the distance between the centers of adjacent contact terminals of a set of uniformly spaced contact terminals). In this embodiment, the pitch of the contact leaves 2 matches the pitch of the IC leads so that there will be perfect registration between the two, as indicated by the dashed lines.

Figure 7:
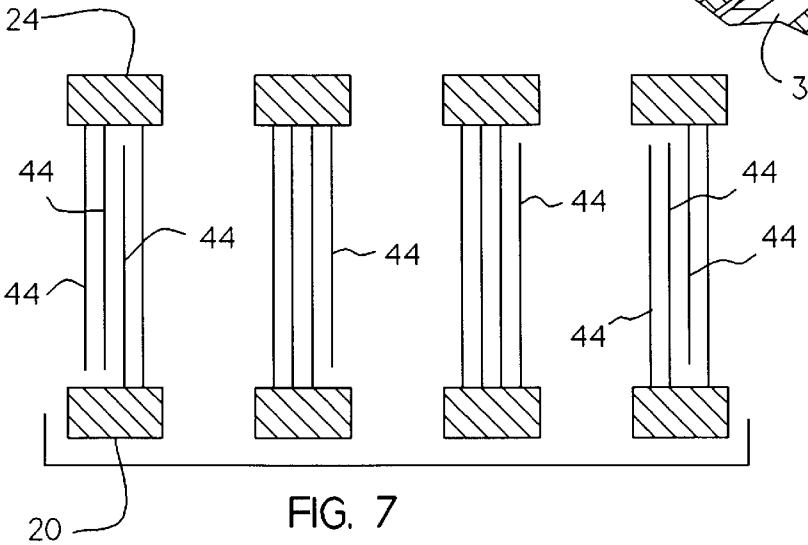
FIG. 7 is a schematic representation of the electrical continuity provided by this invention between opposing terminals.

FIG. 7 best illustrates the effect of the multiple, parallel redundant leaf contacts between things being electrically connected, such as an IC lead 24 and a printed circuit board trace 20, by multiple contact sheets. Even though various leaves 44 have failed to make a connection, for example due to localized surface defects or permanent mechanical damage to them, continuity is nevertheless achieved because of the redundancy.

Figure 8:
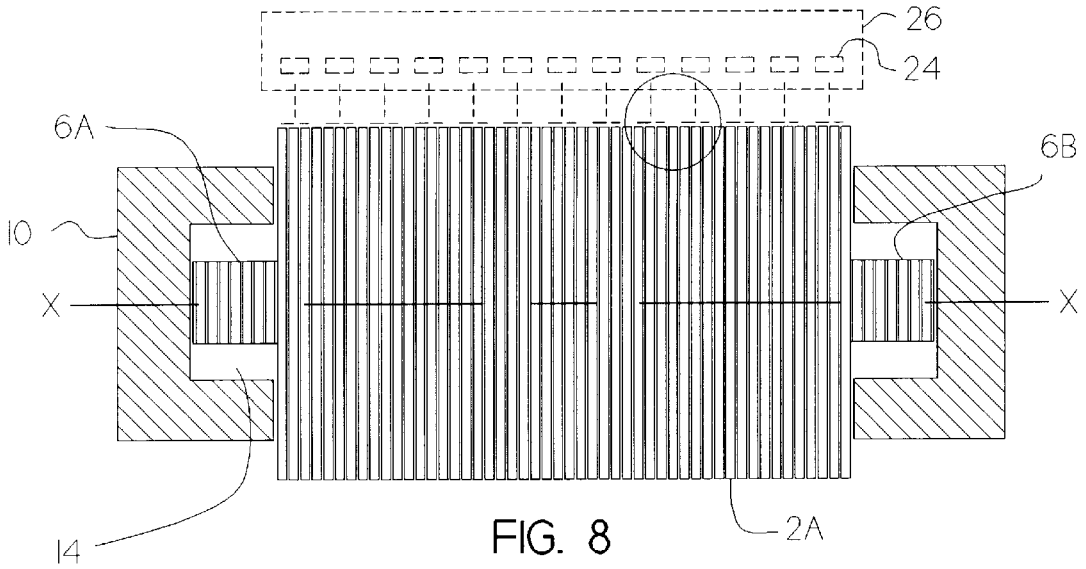
FIG. 8 is a diagrammatical cross-sectional view of a second, pitch-independent embodiment of a contact assembly, according to this invention, taken in similar fashion as FIG. 4.
Figure 8A:
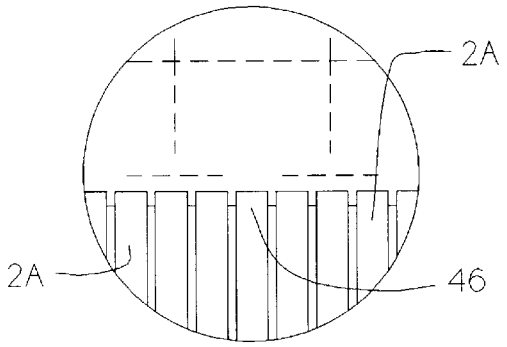
FIG. 8A is a detail view defined by the circle of FIG. 8.

Referring to FIGS. 8 and 8A, illustrated is an embodiment of a contactor according to this invention which is independent of the pitch of the intended contact terminals. The intended contact terminals in this illustration are IC leads 24, and as illustrated the contact sheet set has many more aligned sets of conductive leaves 2A than there are IC leads. This ensures that there will always be at least one aligned set of leaves making contact with each IC lead, while "idle" sets of leaves (those between and not in contact with any IC leads) 46 serve as nonconducting spacers. In this embodiment the width of the leaves' contact tips must be less than the minimum space between the contact terminals of a device to be contacted. This design variation has two very significant advantages:

1. A given contactor can serve a plurality of differently spaced terminals. Therefore, it is pitch independent or universal.

2. Precise alignment between the leaves of each contact sheet and mating terminals is unnecessary.

Certain preferred raw materials are used to manufacture each contact sheet. The contact leaves are preferably made from a metal foil or ribbon or wire made of a material which has good electrical conductivity and good mechanical spring properties. One such material is beryllium copper. The carrier films are preferably made from a polymer which is strong, flexible, dimensionally stable over the intended operating temperature range, and develops good bond strength with a suitable adhesive. The bonding adhesive may be applied as a coating on the polymeric film, such as in Dupont PYRALUX, or it may be applied as a coating on the conductors, or it may be applied separately during manufacture of the contact strip.

Figure 9:
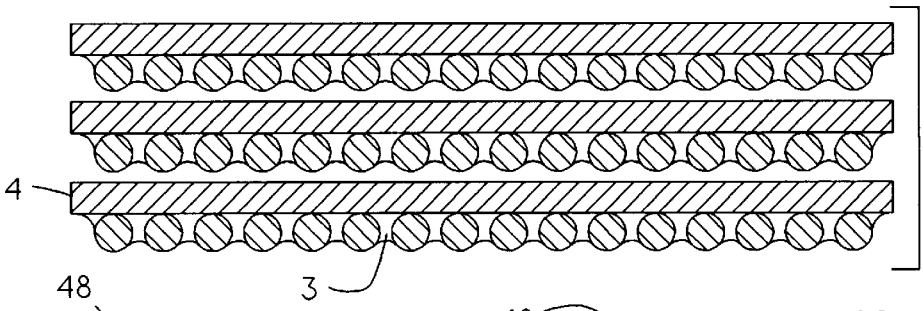
FIG. 9 is an edgewise diagrammatical cross-sectional view of the contact sheets of a pitch-independent contact assembly in which the contact elements are not leaves but rather individual, hardened, round wires.
Figure 10A:
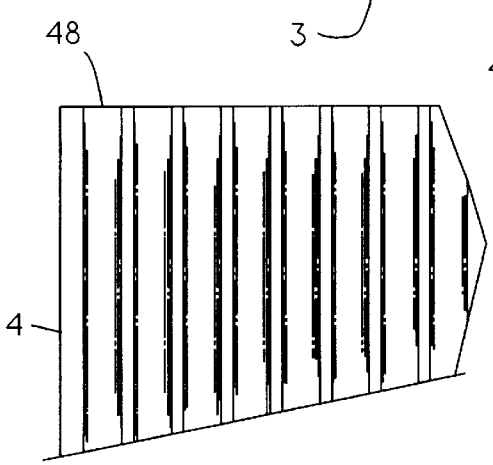
FIGS. 10A and 10B are front elevational views of a contact sheet of FIG. 9.
Figure 10B:
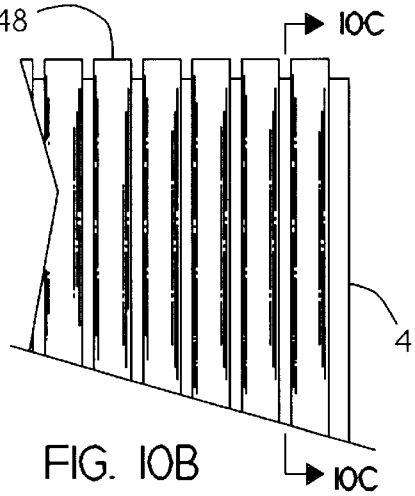
Figure 10C:
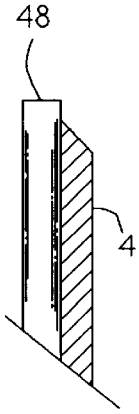
FIG. 10C is a cross-sectional view taken along line 10C—10C of FIG. 10B.

Referring to FIGS. 9–10C, a second embodiment of the contact leaves is illustrated. In this embodiment, the leaves are conductive wires 48 which are bonded to a carrier 4 by adhesive 3. FIG. 9 shows a set of such contact sheets. FIG. 10A shows a contact sheet wherein the contact wires are flush with the carrier at the terminal margins. FIGS. 10B and 10C show a contact sheet on which the wires protrude beyond the carrier's terminal margin.

Figure 11A:
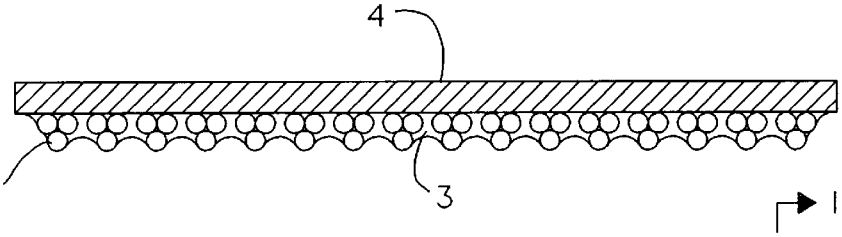
FIG. 11A is an edgewise diagrammatical cross-sectional view of the contact sheets of a pitch-independent contact assembly in which each individual contact element is not a leaf or a round wire, but a wound set of hardened wires.
Figure 11B:
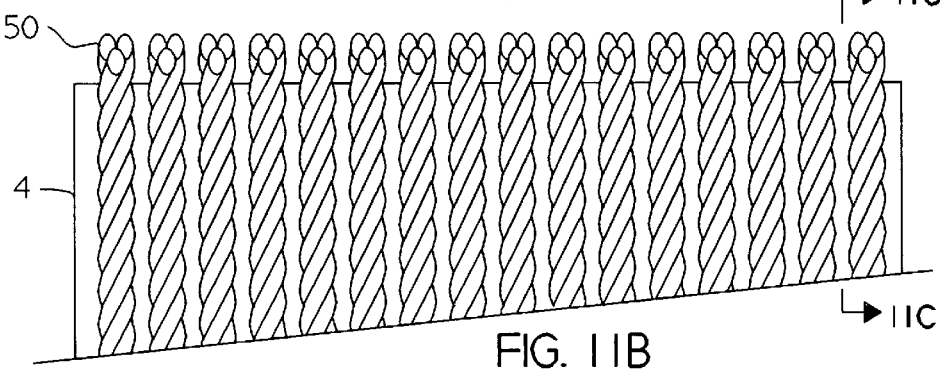
FIG. 11B is a front elevational view of the contact sheet of FIG. 11A.
Figure 11C:
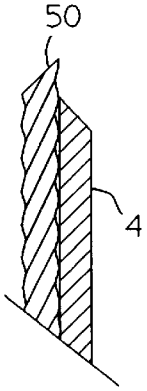
FIG. 11C is a cross-sectional view taken along line 11C—11C of FIG. 11B.

Referring to FIGS. 11A–11C, a third embodiment of the contact leaves is illustrated. In this embodiment, each leaf is a wire rope 50 each having multiple strands.

Figure 12A:
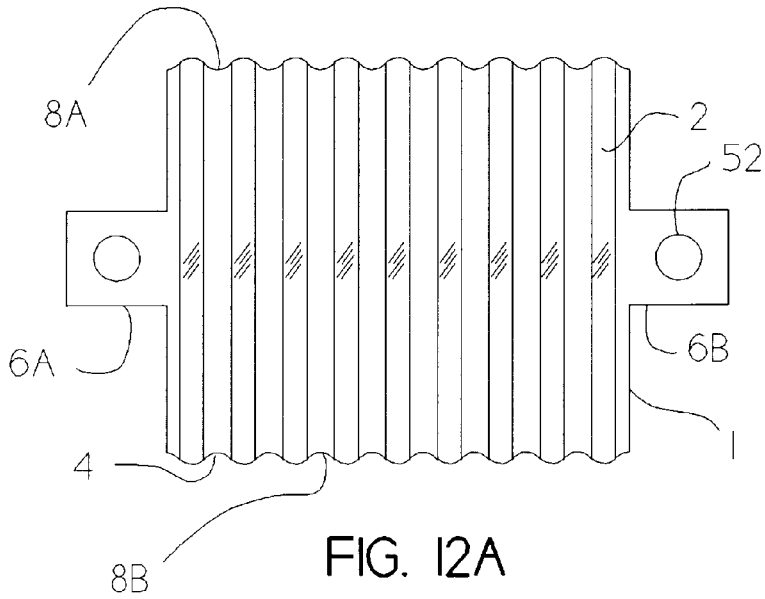
FIGS. 12A and 12B are respectively front and side elevational views of a set of contact sheets, like those of FIG. 4, loosely connected by rivets.
Figure 12B:
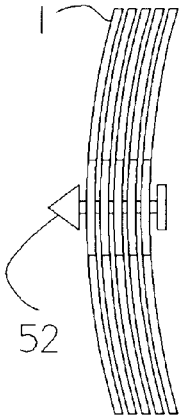

Referring to FIGS. 12A and 12B, a preferred means of loosely bonding the contact sheets into a workable set is illustrated. The sheets are loosely bound by rivets 52 extending through holes defined by the wing tabs, 6A and 6B, of each sheet. The rivets are pointed to facilitate assembly. The pointed ends are forced through the wing tab holes which are slightly smaller than the rivets heads and temporarily deform to accommodate the heads. Once the heads are through the holes resiliently contract. This arrangement keeps the rivets in the holes permanently.

Figure 13:
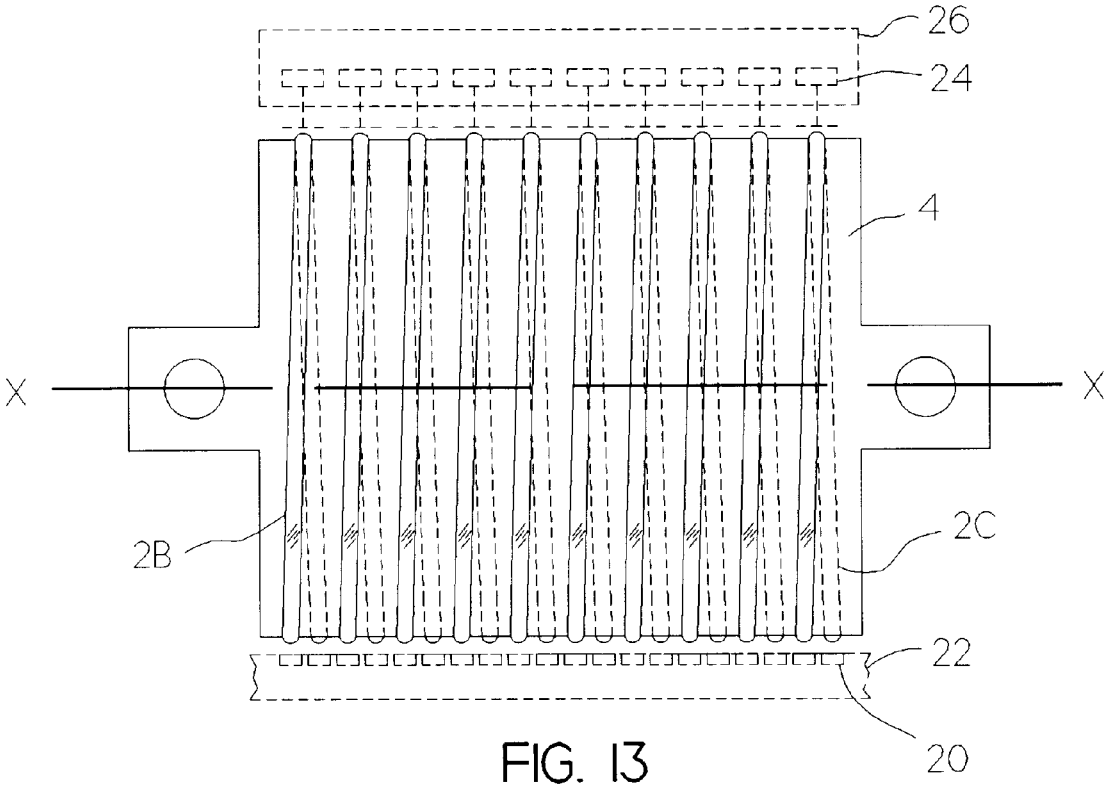
FIG. 13 is a diagrammatical front elevational view of a third embodiment of a contact sheet according to this invention, a sheet that provides a duplication of contacts at one end, to obtain a kelvin connection.

Referring to FIG. 13, an alternative embodiment of a contact sheet set according to this invention is illustrated. In this embodiment, there are two kinds of contact sheets. A first kind wherein the leaves 2B are slightly angled in one direction with respect to the median line x—x and a second kind having leaves 2C which are slightly angled in the opposite direction with respect to the median line. Preferably the set of sheets used in a contactor comprises the two kinds of sheets alternately disposed. This embodiment provides that each contacted terminal at one end, e.g. an IC lead 24, is electrically connected to two terminals, at the other end e.g. two conductive traces 20 on a PC board. This achieves a desirable kelvin connection.

Figure 14:
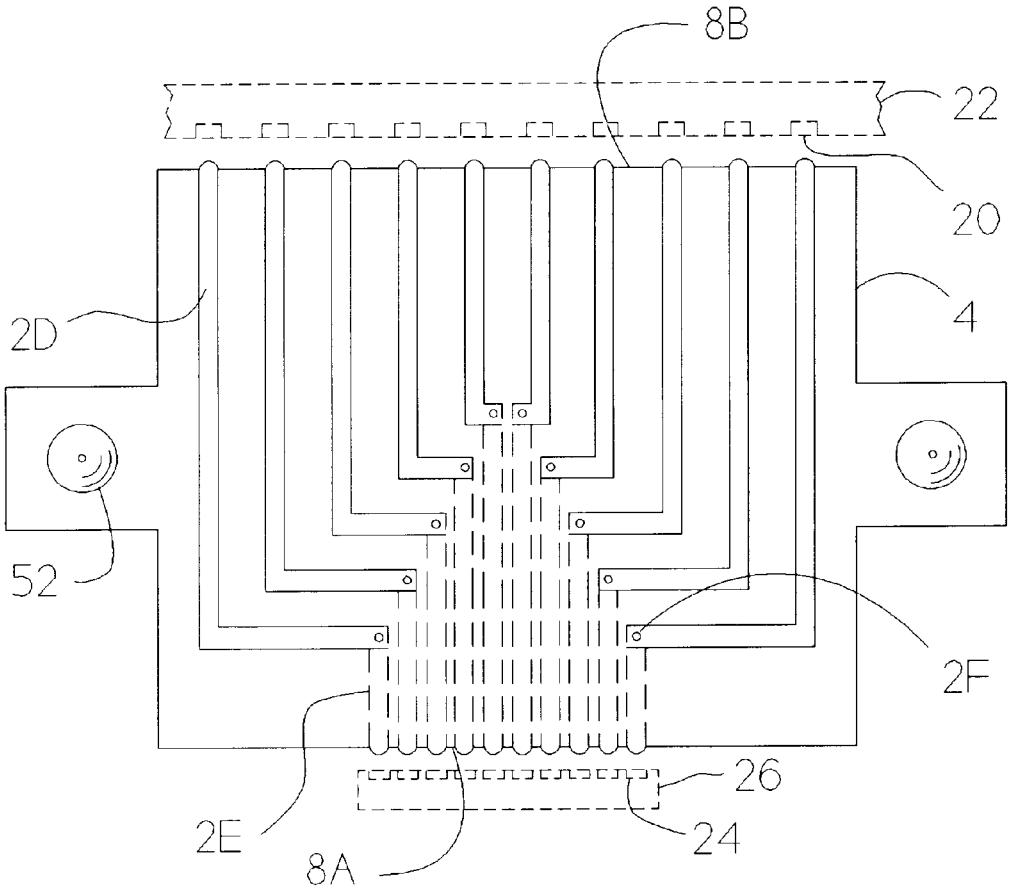
FIG. 14 is a diagrammatical front elevational view of a fourth embodiment of a contact sheet according to this invention, a sheet which transforms a closely spaced lead pitch to a widely spaced lead pitch.
Figure 17:
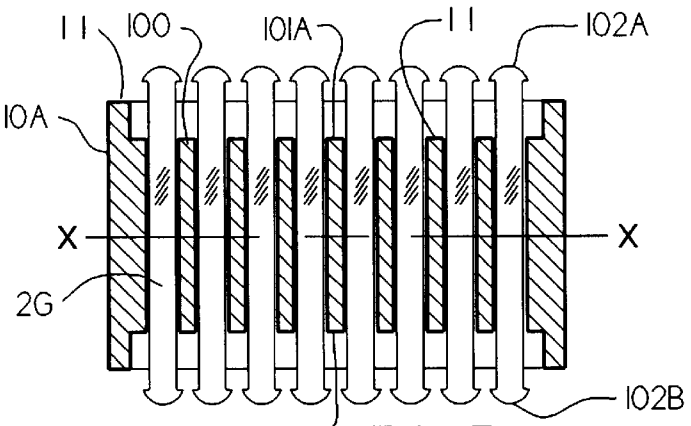
FIG. 17 is a diagrammatical cross-sectional view of the second contact assembly of FIG. 15 taken along line 17—17.
Figure 18:
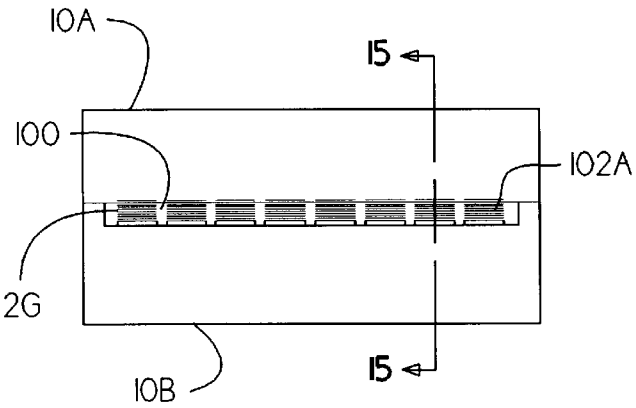
FIG. 18 is a plan view of the second contact assembly of FIG. 15.
Figure 15:
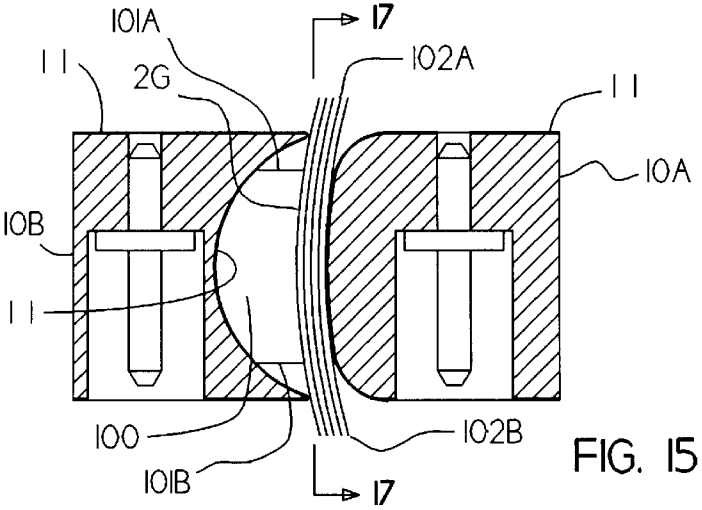
FIG. 15 is a diagrammatical cross-sectional view of a second contact assembly according to this invention.

Referring to FIG. 14, a fifth embodiment of a contact sheet according to this invention is illustrated to include tightly spaced contact leaves 2E and more widely spaced contact leaves 2D. The tightly spaced leaves 2E are either integral parts of respective widely spaced leaves 2D or, optionally, consist of very fine wires which are bonded to carrier film 4 and joined to respective leaves 2D as by welding at junctions 2F. Each tightly spaced leaf 2E may consist of a plurality of adjacent, closely packed fine wires commonly welded at a junction 2F, thereby providing contact redundancy. All the leaves, 2D and 2E, are made from alloys which have high strength, high elasticity, high conductivity and tarnish resistance as previously described leaves. This embodiment transforms one lead pitch to another and accomplishes what is commonly called a "space transformation." Space transformation permits a coarser lead pitch (for example a terminal array 20 on a circuit board 22) to be contacted in electrical communication with a finer lead pitch (for example the leads 24 of an IC 26), making alignment less critical and manufacture less costly.

Referring to FIGS.15–18, a second embodiment of a contact assembly according to this invention is illustrated to include two mating housing sections, 10A and 10B, defining a chamber as described for the first embodiment (FIG. 1) however in this embodiment the contact leaves 2G are not affixed to carriers but rather are grouped in sets, of preferably ten, and the sets are confined in separate slots defined by divider walls 100. The divider walls are integral, planar projections from the convex wall of the housing extending all the way to the concave wall, the ends of the dividers preferably conforming with the curvature, and abutting against, the concave wall. As illustrated there are eight slots keeping the sets of contact leaves parallel to each other, spaced apart, aligned along an axis "X" normal to them, and symmetrical with respect to the axis. The contact leaves 2G each have generally T-shaped ends, 102A and 102B, which are retained by recessed margins, 101A and 101B, of the dividers 100. The margins are recessed so that the contact tips can be compressed flush with the housing surfaces without impacting against a divider margin. This embodiment has the following advantages: (1) it provides more precise positioning of each contact column, i.e. each set of contact leaves, (2) it allows individual contact leaves to move freely to adjust for local irregularities in terminal surfaces, (3) it provides better crosstalk isolation because each contact position is shielded from its neighbors by grounded dividers 100, and (4) it provides additional redundancy because individual leaves are in contact with each other.

Figure 16:
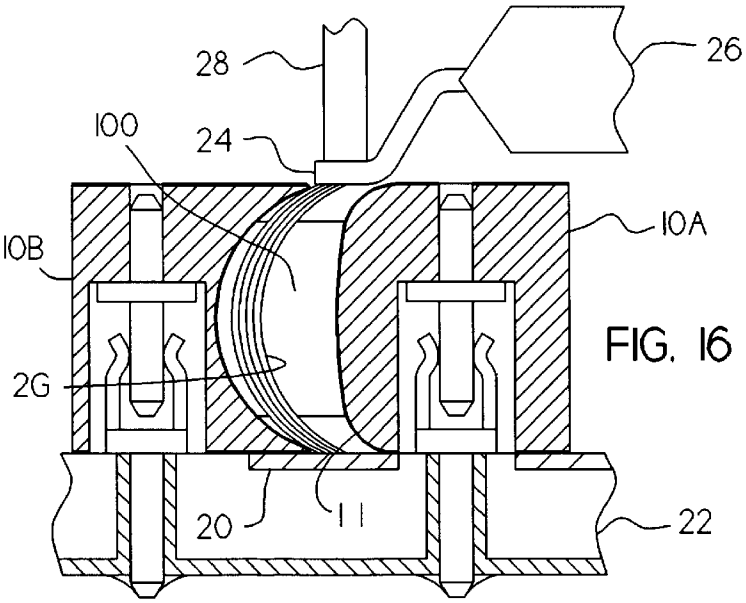
FIG. 16 is a diagrammatical cross-sectional view of the second contact assembly of FIG. 15 in operation providing electrical continuity between a lead of an integrated circuit and a conductive strip on a printed circuit board.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, the contact column buckling from left to right shown in the drawings was an arbitrarily chosen orientation and not a limitation as to the infinite operational orientations of which this is invention is capable. Also the buckling of the columns away from an IC lead as shown in FIGS. 3 and 16 was arbitrarily chosen, because the buckling bias can be reversed so that the columns buckle towards an IC.

We claim:

1. An electrical contactor comprising:

(a) a set of contact sheets, each sheet comprising:

(1) a plurality of elongated conductive leaves each for providing electrical continuity between things in contact with opposite ends of said each elongated conductive leaf; each leaf having a memory urging it to be straight along its length, and (2) a planar, non-conductive, flexible carrier to which the leaves are affixed, for holding them in spaced, fixed relation to each other, each leaf having a memory urging it to be straight in the plane of the carrier, all the leaves terminating at the same two opposite margins of the carrier;

(b) housing means, defining a chamber, for containing the set of contact sheets, said housing means partially bending the set, the bend being oriented to partially fold the terminal margins of the set upon themselves;

(c) the housing means further defining opposite passages from the chamber to outside the housing through which respective terminal margins of the set protrude, the terminal margins being exposed to accept compressive contact forces applied to them; and (d) the chamber further including space to allow further, unobstructed, resilient arcuation of the set of contact sheets whenever a compressive force is applied to their terminal margins.

2. The contactor according to claim 1 wherein the tips of the leaves have sharp corners for cutting through surface contamination.

3. The contactor according to claim 1 wherein the contact sheets fan out in response to compressive force applied against their terminal margins.

4. The contactor according to claim 1 wherein the tips of the leaves are each curved to have a zenith in the direction of operational contact in order to concentrate contact force to a point.

5. The contactor according to claim 1 wherein the leaves are fabricated from a hardened, high conductivity alloy.

6. The contactor according to claim 1 wherein width and spacing of the leaves on each sheet is such that the contactor can effectively mate with a plurality of contact terminal pitches.

7. The contactor according to claim 1 wherein the leaves are encased in a grounded housing which provides both shielding and an impedance controlled transmission line environment for signals traversing the leaves.

8. The contactor according to claim 1 wherein the aligned leaves are electrically interconnected.

9. The contactor according to claim 1 further comprising means for equalizing contacting forces applied against the terminal margins.

10. The contactor according to claim 9 wherein the means for equalizing comprises:

a. clearance means, defined by the housing, for allowing the set of contact sheets to be moveable back and forth in a direction parallel to the leaves, and b. means for limiting the range of array movement.

11. The contactor according to claim 1, wherein a contact sheet comprises a woven fabric as a carrier and leaves bonded thereto.

12. The contactor according to claim 11, wherein the leaves of a contact sheet are an integral part of a woven sheet of fabric.

13. The contactor according to claim 11, wherein the carrier sheet comprises a plurality of transverse, non-conducting threads of fabric bonded to the leaves at an angle normal to their longitudinal axis.

14. The contactor according to claim 13 wherein the threads of fabric are made of KEVLAR.

15. The contactor according to claim 10 wherein the carrier of each contact sheet comprises a polymeric film.

16. The contactor according to claim 15 wherein the polymeric film comprises polyimide.

17. The contactor according to claim 15 wherein the means for limiting the range of array movement comprises:

(a) projections extending laterally from opposite sides of at least some of the polymeric film carriers, (b) for each projection, a pair of opposing walls within the chamber disposed to be opposite limits to movement of the projection in the direction of set movement.

18. The contactor according to claim 17 further comprising space transformation.

* * * * *